US007739773B2

(12) United States Patent
Schliemann et al.

(10) Patent No.: US 7,739,773 B2
(45) Date of Patent: Jun. 22, 2010

(54) PORTABLE BLOWER

(75) Inventors: Harald Schliemann, Waiblingen (DE); Manfred Rabis, Schwaikheim (DE); Daniel Hirt, Kirchentellinsfurt (DE)

(73) Assignee: Andreas Stihl AG & Co. KG (DE)

( * ) Notice: Subject to any disclaimer, the term of this patent is extended or adjusted under 35 U.S.C. 154(b) by 0 days.

(21) Appl. No.: 11/836,572

(22) Filed: Aug. 9, 2007

(65) Prior Publication Data

US 2008/0189904 A1 Aug. 14, 2008

(30) Foreign Application Priority Data

Aug. 10, 2006 (DE) ..... 10 2006 037 460

(51) Int. Cl.
*A47L 5/24* (2006.01)
*A47L 5/00* (2006.01)

(52) U.S. Cl. ..... 15/344; 15/405

(58) Field of Classification Search ..... 15/344, 15/405

See application file for complete search history.

(56) References Cited

U.S. PATENT DOCUMENTS 4,132,507 A * 1/1979 Akiyama et al. ..... 417/234
4,286,675 A * 9/1981 Tuggle ..... 173/213
4,413,371 A * 11/1983 Tuggle et al. ..... 15/405
5,722,111 A * 3/1998 Sowell et al. ..... 15/330
5,768,749 A * 6/1998 Ohi et al. ..... 15/405
5,809,653 A * 9/1998 Everts et al. ..... 30/122
2006/0010850 A1 * 1/2006 Jacobson et al. ..... 60/39.01

FOREIGN PATENT DOCUMENTS

JP 58172492 A * 10/1983

* cited by examiner

*Primary Examiner*—Bryan R Muller
(74) *Attorney, Agent, or Firm*—Robert W. Becker; Robert Becker & Assoc.

(57) ABSTRACT

A portable blower having a motor unit that includes a drive motor disposed in an engine housing. The blower has a blower unit that is provided with a blower housing that is separate from the engine housing. The blower unit includes an axial fan that is driven by the drive motor via a drive shaft. During operation the axial fan conveys operating air in the direction of the axis of rotation of the axial fan through a blower tube disposed downstream of the axial fan. An ergonomic operation and a good operating result can be achieved if the motor unit includes a guide tube on which is secured at least one handle. The engine housing is disposed at one end of the guide tube and the blower unit is disposed at the other end of the guide tube. The drive shaft extends through the guide tube. The length of the guide tube between the engine housing and the blower unit corresponds to at least half of the length of the blower tube.

15 Claims, 4 Drawing Sheets

PORTABLE BLOWER

The instant application should be granted the priority date of Aug. 10, 2006 the filing date of the corresponding German patent application DE 10 2006 037 460.6.

BACKGROUND OF THE INVENTION

The present invention relates to a portable blower.

U.S. Pat. No. 4,413,371 discloses a portable blower having a motor unit and a blower unit. The blower unit has an axial fan that is disposed directly adjacent to the motor unit. A long blower tube extends to the ground from the fan. Operating air is drawn in via a gap between the blower tube and the drive motor and via openings in the upper side of the blower tube.

It is an object of the present invention to provide a portable blower with which a good cleaning result can be achieved and which enables ergonomic operation.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
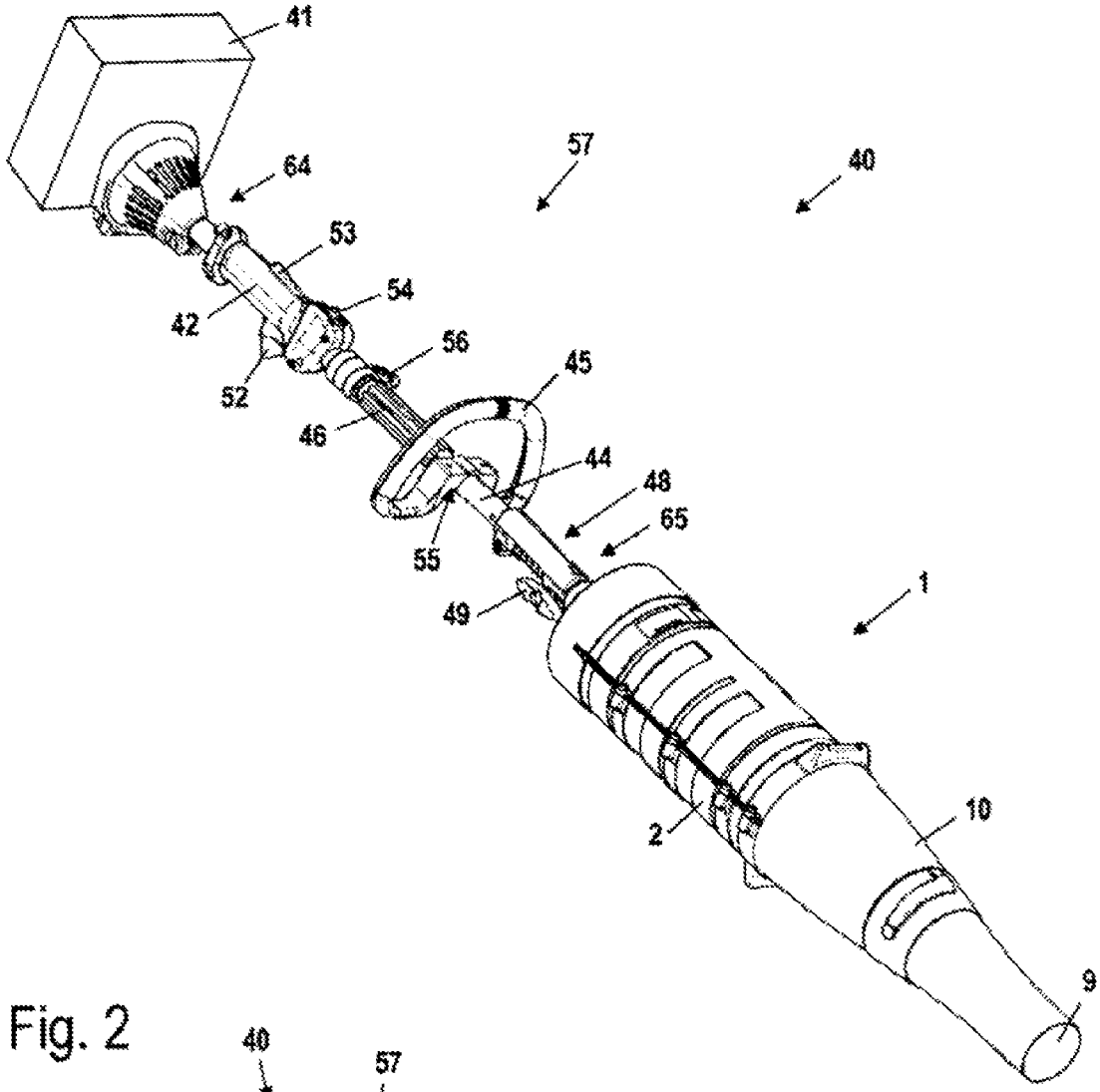
FIG. 1 is a perspective illustration of a first exemplary embodiment of a blower.

The portable blower of the present application comprises a motor unit, including a drive motor disposed in an engine housing, and a blower unit provided with a blower housing that is separate from the engine housing; the blower unit includes an axial fan that is driven by the drive motor via a drive shaft; during operation of the blower, the axial fan conveys operating air in the direction of the axis of rotation of the axial fan through a blower tube disposed downstream of the axial fan; the motor unit also includes a guide tube on which is secured at least one handle means for guiding the blower during operation thereof; the engine housing is disposed at one end of the guide tube and the blower unit is disposed at the other end of the guide tube, with the drive shaft extending through the guide tube and with the length of the guide tube, measured between the engine housing and the blower housing, corresponding to at least half of the length of the blower tube.

The arrangement of at least one handle means on a guide tube disposed between the engine housing and the blower unit permits an ergonomic operation. The weight of the drive motor acts at one end of the guide tube, and the weight of the blower unit acts at the other end. As a result, the blower is counterbalanced about the region of the handle means, thus enabling an ergonomic, energy-saving operation. The guide tube furthermore dictates a spacing between engine housing and blower housing, so that the intake surface of the blower unit is also spaced from the engine housing and is not partially covered by the engine housing. As a result, during intake the resistance to flow can be reduced, hence increasing the power of the blower. The relatively long guide tube between engine housing and blower housing additionally enables the blower tube to be shorter. This also reduces the resistance to flow downstream of the axial fan, and thus increases the blowing capacity. In this connection, engine housing denotes housing parts, such as covers and guards, that at least partially cover the drive motor and components driven by the drive motor. Further in this connection, the engine housing must not be a closed housing, but rather can also have an open configuration over large portions thereof.

The length of the guide tube between the engine housing and the blower housing advantageously corresponds at most to four times the length of the blower tube of the blower unit. As a result, an adequate nozzle effect can be achieved at the blower tube. At the same time, in this way a balanced weight distribution can be achieved at the handle means. To enable an ergonomic guidance of the blower, a handle means secured to the guide tube can in particular be embodied as a U-handle. A second handgrip is advantageously secured to the guide tube, with at least one control element for the drive motor being disposed thereon. As a result, the operator can grasp the motor with both hands at the guide tube. To enable an ergonomic operation, it is also possible to secure to the guide tube a control handle having a first handgrip and a second handgrip. As a result, the blower can be easily guided with two hands. At least one control element, in particular the throttle trigger of the drive motor, is advantageously disposed on one of the handgrips.

The blower unit can be detachably held on the guide tube via a coupling unit. As a result, it is easily possible to remove or replace the blower unit. In addition, the blower can be easily disassembled for transport. The motor unit can advantageously be connected to various tool fixtures via the coupling unit. As a result, the motor unit can be used in many different ways. For the operation of different tool fixtures, such as a power sweeper, a hedge trimmer, a pole pruner, or the like, only a single motor unit is required that can be connected to the respectively required tool fixture.

A reliable connection can be easily ensured if the blower unit has a connector that cooperates with the coupling unit, whereby the connector has an axial length of at least 40 mm.

To achieve an adequate fan capacity, the axial fan has several stages. The ratio of the drive power of the drive motor to the number of stages of the axial fan is advantageously approximately 0.25 kw to approximately 0.45 kw. In this connection, the axial fan advantageously has one to ten stages, in particular two to five stages; three stages have been shown to be advantageous. The ratio of the drive power of the drive motor in watts to the conveying volume of the axial fan in $m^3/h$ is advantageously approximately 0.9 to approximately 1.1, in particular approximately 1.

The drive motor is advantageously an internal combustion engine. In this connection, the drive motor is in particular a two-cycle engine or a mixture-lubricated four-cycle engine. Favorable conditions result if the length of the axial fan is approximately 0.3 to 1.5 times the length of the blower tube. The blower tube is advantageously rotationally symmetrical relative to the axis of rotation of the axial fan. This results in symmetrical flow conditions in the blower tube, and turbulence or the like, which can lead to an increase of the resistance to flow, can be largely avoided.

The axial fan advantageously has at least one fan wheel driven by the drive shaft, and at least one guide wheel fixedly disposed in the blower housing. In this connection, the fan wheel and the guide wheel in particular form one stage of the axial fan. All of the fan wheels and all of the guide wheels of the axial fan, where a multi-stage configuration of the axial fan is provided, are expediently respectively identical to one another. This results in a straightforward construction, and the number of the different components required during manufacture is reduced. A further simplification of the manufacture is achieved if the blower housing has at least two identical housing sections, and is advantageously divided approximately parallel to the axis of rotation of the axial fan. In this connection, within manufacturing tolerances the division is advantageously exactly parallel to the axis of rotation of the axial fan. As a result, the fan wheels and the guide wheels of the axial fan can easily be installed in the housing. The axial fan can be placed into one housing section and can subsequently be closed off by one or more further housing sections. It is thereby possible to avoid having to insert the axial fan in the longitudinal direction of the blower.

Further specific features of the present invention will be described in detail subsequently.

DESCRIPTION OF SPECIFIC EMBODIMENTS

Referring now to the drawings in detail, the portable blower 40 shown in FIG. 1 has a blower unit 1 and a motor unit 57. The blower unit 1 is secured to a coupling unit 48 of the motor unit 57. The blower unit 1 is detachably held on the motor unit 57. An actuating screw 49 is provided on the coupling unit 48 for detachment of the blower unit 1.

The motor unit 57 includes an engine housing 41 and a guide tube 44 that is secured to the engine housing 41. In the illustrated embodiment, the engine housing 41 is schematically illustrated as a closed engine housing. However, the engine housing 41 can also be largely open, and can, for example, be formed by only a single cover element, so that a drive motor disposed in the engine housing 41 is substantially freely accessible from the outside. A first end 64 of the guide tube 44 is secured to the engine housing 41, and the coupling unit 48, via which the guide tube 44 is connected to the blower unit 1, is disposed at the opposite, second end 65 of the guide tube 44. A first handgrip 42 is disposed on, and surrounds, the guide tube 44 adjacent to the engine housing 41. Control elements for controlling a drive motor of the blower 40, namely a throttle trigger 52, a throttle block 53, and a stop switch 54, are disposed on the first handgrip 42. Adjacent to the coupling unit 48, a U-handle 45 is secured to the guide tube 44 for guiding the blower 40. The U-handle 45 has an attachment mechanism 55 via which it is held on the guide tube 44. A second handgrip 46 is disposed on the guide tube 44 between the U-handle 45 and the first handgrip 42. The second handgrip 46 has a tubular configuration and surrounds the guide tube 44. The second handgrip 46 can, for example, be embodied as a profiled tube of polymeric material. Secured to the guide tube 44 between the first handgrip 42 and the second handgrip 46 is a mounting eyelet 56 via which the blower 40 can be hooked onto a support strap and can be carried by an operator over the shoulder.

The blower unit 1 includes a blower housing 2 to which a blower tube 10 is secured. At that end remote from the guide tube 44 the blower tube 10 has an air outlet opening 9 through which the operating air is conveyed from the blower unit 1.

Figure 2:
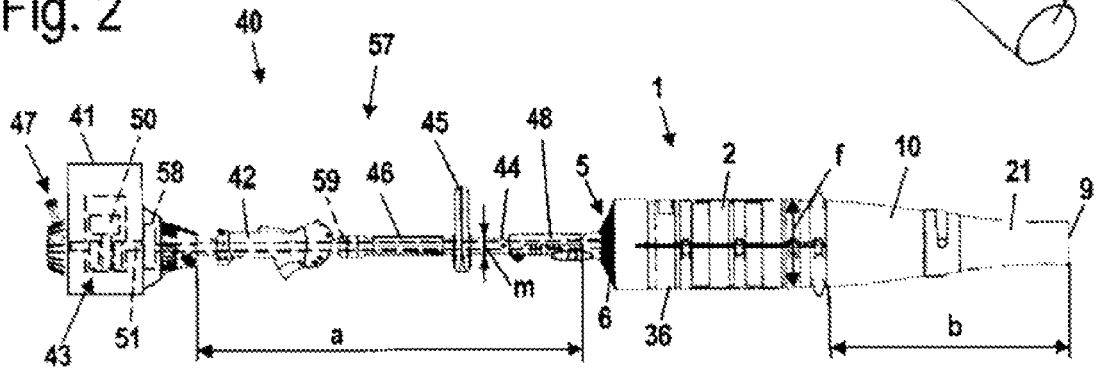
FIG. 2 is a side view of the blower of FIG. 1.

As shown in FIG. 2, the blower 40 has a drive motor 43 disposed in the engine housing 41 for driving the blower unit 1. In the illustrated embodiment, the drive motor 43 is an internal combustion engine, in particular a 2-cycle engine or a mixture-lubricated 4-cycle engine. The drive motor 43 has a piston 50 that rotatingly drives a crankshaft 51. To start the motor, the blower 40 has a starting device 47 that is disposed in the engine housing 41. On that side that faces the guide tube 44, the crankshaft 51 is connected to a drive shaft 59 via a coupling or clutch 58. The drive shaft 59 extends through the guide tube 44 to the blower unit 1.

The blower unit 1 has a cylindrical portion 36 at that end face of which that faces the guide tube 44 is disposed a cover grate 6. The cover grate 6 is provided with a plurality of air inlet openings 5 via which the operating air is drawn into the blower unit 1. The cylindrical portion 36 has a diameter f that is advantageously approximately 90 mm to approximately 200 mm. The diameter m of the guide tube 44 is considerably less than the diameter f of the cylindrical portion 36. As a result, an adequately large intake surface is made available at the cover crate 6.

As shown in FIG. 2, the blower tube 10 has a discharge nozzle 21 that is detachably held on that portion of the blower tube 10 that is secured to the blower housing 2. The guide tube 44 has a length a, as measured in the longitudinal direction of the guide tube, that corresponds to at least half of the length b of the blower tube 10. The length a is advantageously less than four times, and in particular less than two times, the length b of the blower tube 10. Due to the fact that the guide tube 44 is relatively long and the blower tube 10 is relatively short, the air inlet openings 5 are freely accessible and the flow resistance of the blower tube 10 is relatively low due to its short axial length. The lengths a and b are advantageously measured parallel to the axis of rotation 31 of the axial or axial-flow fan 11 shown in FIG. 4.

Figure 3:
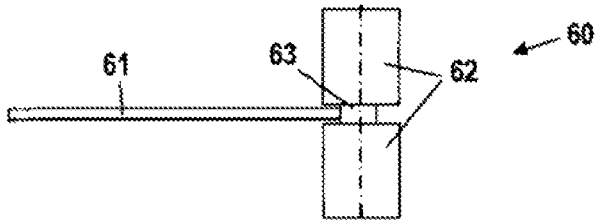
FIG. 3 is a schematic illustration of a power sweeper.

The blower unit 1 is detachably held on the motor unit 57. Instead of the blower unit 1, other tool fixtures can also be secured to the motor unit 57. As an example thereof, a power sweeper 60 is schematically shown in FIG. 3. The power sweeper 60 has a guide tube portion 61, which can be secured to the coupling unit 48. At that end of the guide tube portion 61 that faces the ground, the power sweeper 60 is provided with a gear mechanism 63, which rotatingly drives two reversible brushes 62 that are disposed on both sides of the gear mechanism 63.

The blower unit 1 is shown in detail in FIGS. 3 to 6. The blower unit 1 has a connector 3 for connection to the coupling unit 48. The connector 3 has an axial length i, measured in the direction of the axis of rotation 31, that is advantageously at least 40 mm, and in particular at least 50 mm. Adjoining the connector 3 is an extension 66 of the cover grate 6. The extension 66 has an outer diameter l that is somewhat greater than the outer diameter m of the guide tube 44.

Figure 4:
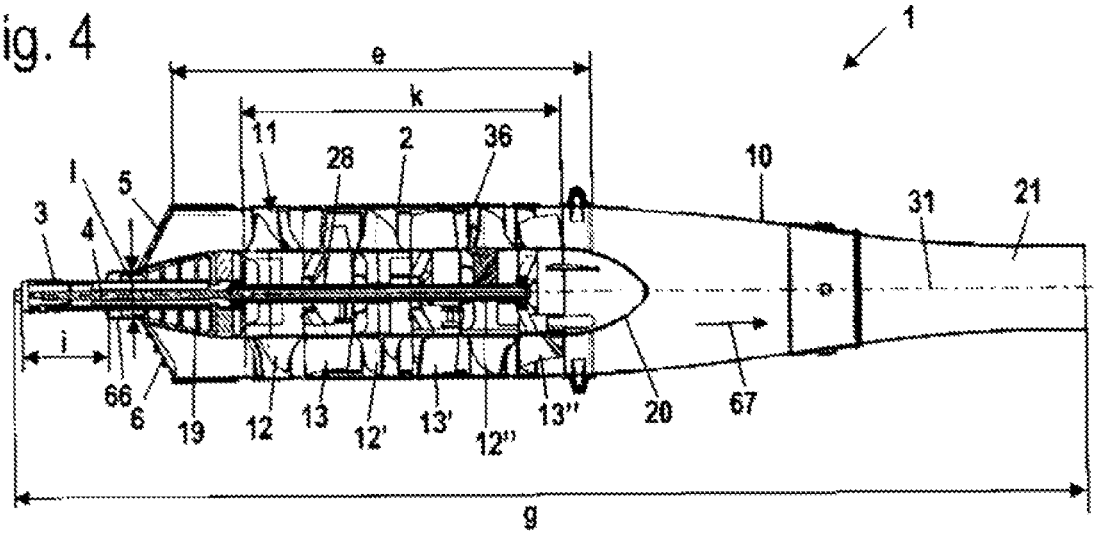
FIG. 4 is a longitudinal cross-sectional view through the blower of FIG. 1.
Figure 5:
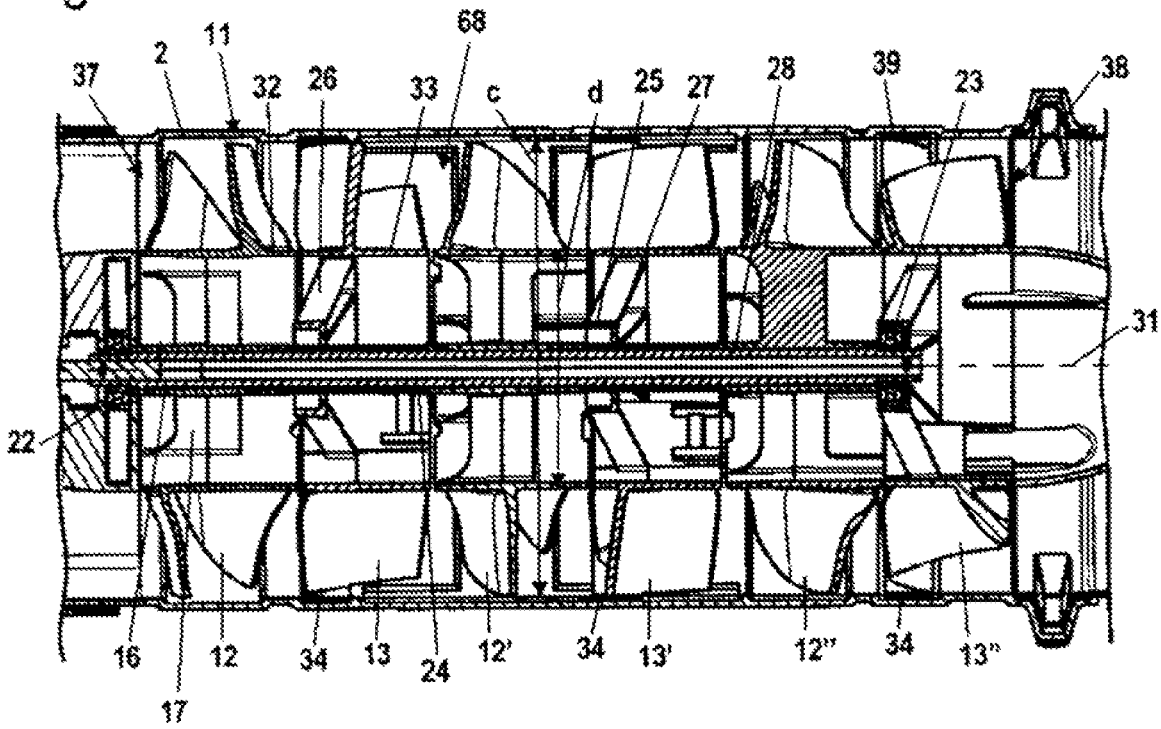
FIG. 5 is a cross-sectioned enlarged illustration of the axial fan of the blower unit of FIG. 4.
Figure 6:
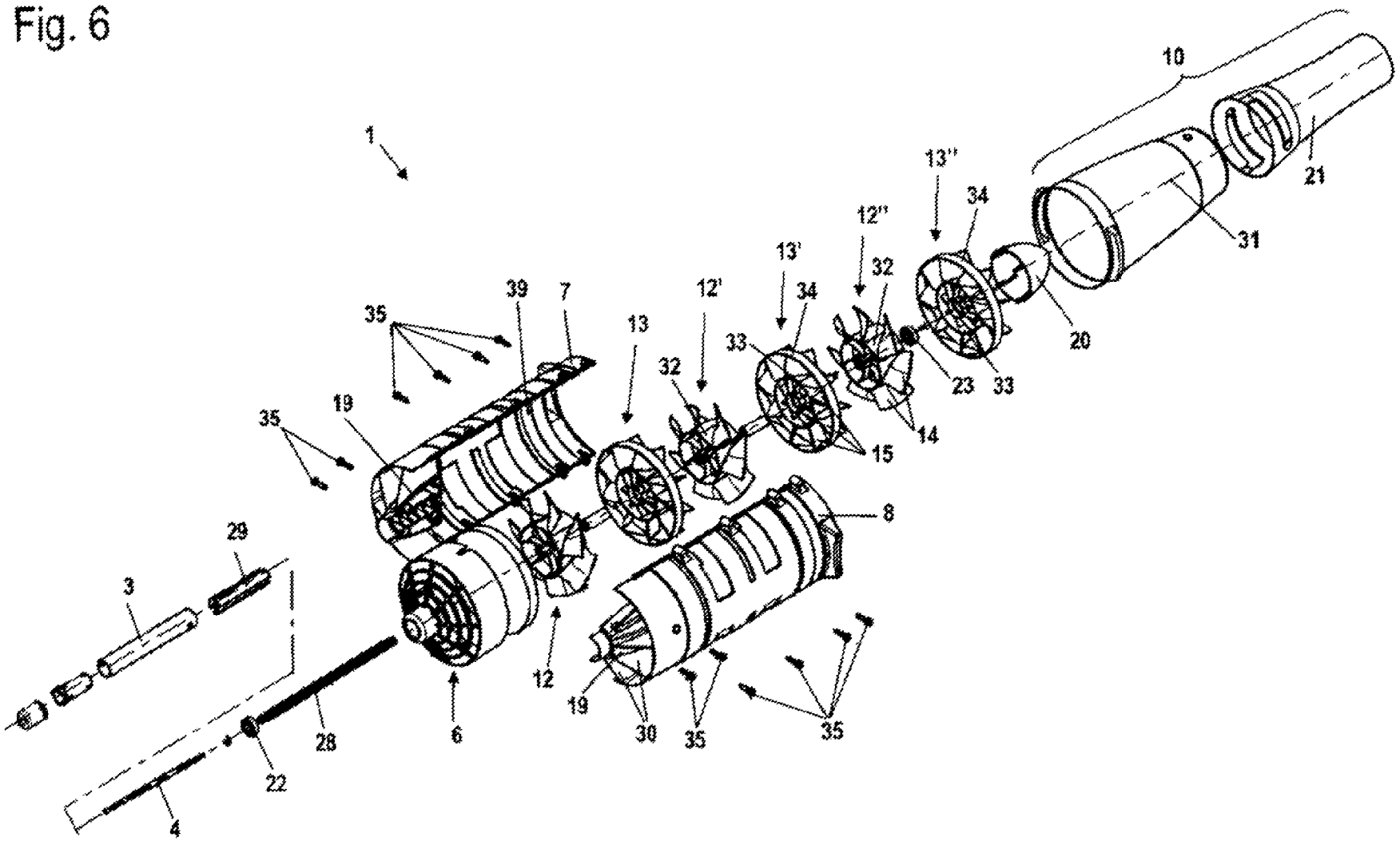
FIG. 6 is an exploded view of the blower unit.

A flow guide element 19 is disposed in the blower housing 2 adjacent to the air inlet openings 5. The flow guide element 19 conveys drawn-in operating air to an axial or axial-flow fan 11 disposed in the blower housing 2. The axial fan 11 has three fan wheels 12, 12', 12" as well as three guide wheels 13, 13', 13". The fan wheels 12 are fixedly connected with a drive shaft portion 28 that is driven by the drive shaft 59; The fan wheels 12 are rotatingly driven by the drive shaft portion 28 about the axis of rotation 31. The drive shaft 59 is connected to the drive shaft portion 28 via an input shaft 4 of the blower unit 1 (FIG. 6). The guide wheels 13, 13', 13" are stationarily held in the blower housing 2. As also shown in FIG. 5, each of the fan wheels 12, 12', 12" has a sleeve portion 32, the outer diameter d of which adjoins the flow guide element 19. The guide wheels 13, 13', 13" have a corresponding sleeve portion 33, which also has an outer diameter d. The cylindrical portion 36 shown in FIG. 4 has an axial length e that is advantageously approximately 300 mm to approximately 450 mm. The diameter f of the cylinder portion 36 shown in FIG. 2 is advantageously approximately 0.3 to 0.5 times the length e of the cylindrical portion 36.

The blower unit 1 has an axial overall length g, measured in the direction of the axis of rotation 31, that is advantageously approximately 800 mm to approximately 1200 mm. The axial overall length g of the blower unit 1 is advantageously approximately two to four times an axial length k of the axial fan 11. The overall length g is advantageously approximately three times the length k. In this connection, the length k of the axial fan 11 is advantageously approximately 0.3 to 1.5 times the length b of the blower tube 10 (FIG. 2). As also shown in FIG. 4, disposed at the outlet out of the axial fan 11 is a second flow guide element 20, that portion of which that faces the axial fan 11 having an outer diameter that corresponds to the outer diameter d of the hubs or portions 32 and 33 of the fan wheels 12 and guide wheels 13; the outer diameter of the flow guide element 20 then decreases. The axial fan 11 conveys operating air in the direction of the axis of rotation 31 through the blower unit 1. This is indicated in FIG. 4 by the arrow 67 in the blower tube 10.

As shown in FIG. 5 the axial fan 11 has a fan inlet 37 and a fan outlet 38. The axial fan 11 has a three-stage configuration, whereby each fan stage includes a fan wheel 12, 12', 12" and a guide wheel 13, 13', 13" disposed downstream of the fan wheel 12, 12', 12". All of the fan wheels 12, 12', 12" have an identical configuration. Similarly, all of the guide wheels 13, 13', 13" have an identical configuration. A first bearing 22 of the drive shaft portion 28 is disposed at the flow guide element 19. A second bearing 23 is disposed in the region of the fan outlet 38 at the downstream third guide wheel 13". To accommodate the bearing 23, the guide wheel 13" has an inner ring 25, which is also provided for the identically configured guide wheels 13 and 13', and which supports the sleeve portion 33 via radially outwardly extending spokes 26. Disposed on the inner ring 25 is a collar 27 that extends perpendicular to the axis of rotation 31 and via which the bearing 23 is laterally supported.

A respective outer ring 34 is provided on the outer peripheries of the guide wheels 13, 13', 13" via which they are supported on the blower housing 2. At the first guide wheel 13 and at the third guide wheel 13", the blower housing 2 has a respective recessed area 39 in which the outer ring 34 is disposed. Provided on the second guide wheel 13' is a corresponding recessed area that, however, does not extend over the entire periphery of the blower housing 2. The recessed area 39 secures the outer ring 34 in the longitudinal direction of the axis of rotation 31. To secure the axial position of the fan wheels 12, 12', 12", disposed in the interior of the guide wheels 13 and 13' is a respective spacer 24 that extends on the outer periphery of the drive shaft portion 28 between adjacent hubs 16 of the fan wheels 12, 12', 12". The fan wheels 12, 12', 12" are fixedly held on the drive shaft portion 28 via the hubs 16. The inner profile of the hubs 16 corresponds to the outer profile of the drive shaft portion 28. The hubs 16 are connected to the sleeve portions 32 via radially outwardly extending spokes 17.

The outer diameter c of the fan wheels 12, 12', 12" is advantageously approximately 140 mm to approximately 170 mm. The outer diameter b of the sleeve portions 32, 33 is advantageously approximately 70 mm to approximately 100 mm. The ratio of the outer diameter d of the sleeve portions 32, 33 to the outer diameter c of the fan wheels 12, 12', 12" is advantageously at least approximately 0.5, whereby a value of greater than 0.5 is advantageous. A flow-through area 68 is formed between the sleeve portions 32 and 33 and the wall of the blower housing 2 in the cylindrical portion 36. The ratio of the flow cross-section region of the air outlet opening 9 to the flow cross-section of the flow-through area 68 of the axial fan 11 is advantageously greater than 0.25. A ratio of greater than 0.3 is particularly advantageous, and a value of approximately 0.37 has been shown to be expedient.

To achieve an adequately large air in-flow opening, the diameter m of the guide tube 44 is advantageously approximately 20 to 40% of the diameter d of the sleeve portions 32, 33. The diameter l of the extension 66 is advantageously approximately 15 to 35% of the outer diameter d of the sleeve portions 32 and 33.

FIG. 6 is an exploded view showing the construction of the axial fan 11. The blower housing 2 is composed of two identical housing sections 7 and 8, which are divided parallel to the axis of rotation 31. The flow guide element 19 is formed on the housing sections 7 and 8. Provided radially outwardly of the flow guide element 19 are guide surfaces or fins 30 that convey the drawn-in operating air to the axial fan 11. The input shaft 4 is supported in the connector 3 via a support element 29 and is guided thereby. The fan wheels 12, 12', 12" are provided with fan wheel vanes 14, and the guide wheels 13, 13', 13" are provided with guide wheel vanes 15. The number of the fan wheel vanes 14 and of the guide wheel vanes 15 are respectively different from one another. An odd number of vanes 14, 15 is advantageously respectively provided. The two, housing sections 7 and 8 are interconnected by screws 35. As shown in the drawings, the blower tube 10 is rotationally symmetrical relative to the axis of rotation 31. The discharge nozzle 21 is detachably held on the stationary portion of the blower tube 10 via a bayonet connection.

The drive motor 43 is designed such that the ratio of its drive power to the number of stages of the axial fan 11 is approximately 0.25 kw to approximately 0.45 kw. With a three-stage axial fan 11, the drive power of the drive motor 43 is accordingly advantageously approximately 0.75 kw to approximately 1.35 kw. The ratio of the drive power of the drive motor 43 in watts to the conveying volume of the axial fan 11 in $m^3/h$ is approximately 0.9 to 1.1. The ratio is advantageously approximately 1.

Figure 7:
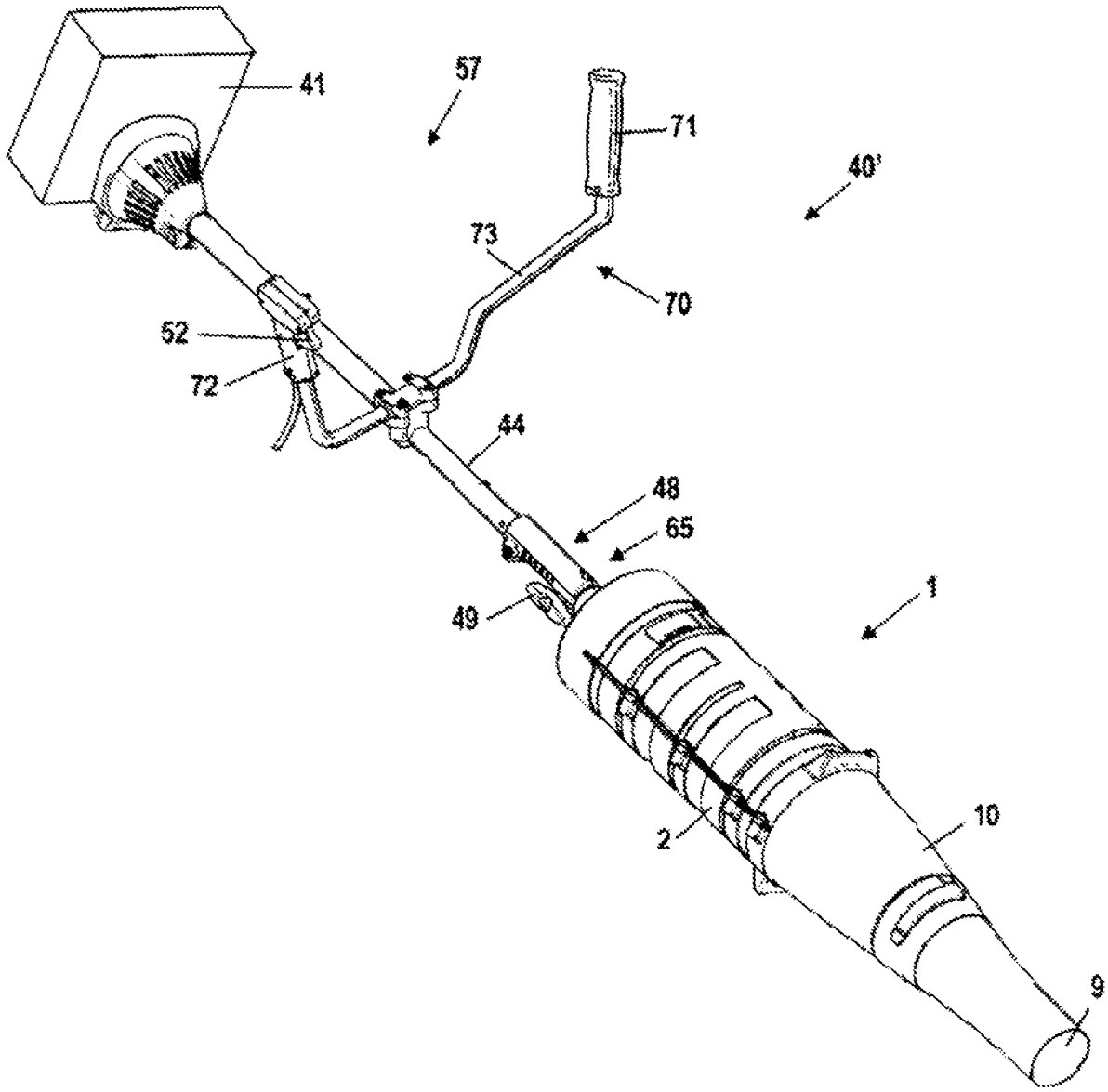
FIG. 7 is a perspective illustration of a further exemplary embodiment of a blower.

FIG. 7 shows a further embodiment of a blower 40'. The same reference numerals represent the same elements as in FIGS. 1 to 6. A control handle 70 is secured to the guide tube 44 of the blower 45. The control handle 70 is provided with a bent tube 73 that extends transverse to the guide tube 44, and on the ends of which are secured a first handgrip 71 and a second handgrip 72. The second handgrip 72 is provided with control elements, namely the throttle trigger 52 for operating the drive motor 43, as well as a non-illustrated throttle block and a stop switch. With the control handle 70, the blower 40' can be guided with two hands. In addition, a non-illustrated mounting eyelet 56 can be disposed on the housing 41 or on the guide tube 44 so that the blower 40' can be carried over the shoulder. As a result of the control handle 70, no other handgrips are required on the guide tube 44. In comparison to the blower 4Q of FIGS. 1 to 6, the handgrip 42, the U-handle 45, and the handgrip 46 are eliminated. However, one or more of these handgrips can also additionally be provided on the guide tube 44.

The specification incorporates by reference the disclosure of German priority document DE 102006 037 460.6 filed 10 Aug. 2006.

The present invention is, of course, in no way restricted to the specific disclosure of the specification and drawings, but also encompasses any modifications within the scope of the appended claims.

The invention claimed is:

1. A portable blower, comprising:

a motor unit that includes a drive motor disposed in an engine housing, and a blower unit, wherein said blower unit is provided with a blower housing that is separate from said engine housing, further wherein said blower unit includes an axial fan that is driven by said drive motor via a drive shaft, wherein during operation of said blower said axial fan is adapted to convey operating air in the direction of an axis of rotation of said axial fan through a blower tube disposed downstream of said axial fan, wherein said motor unit further includes a guide tube on which is secured at least one handle for guiding said blower during operation thereof, further wherein said engine housing is disposed at a first end of said guide tube and said blower unit is disposed at a second end of said guide tube, further wherein said drive shaft extends through said guide tube, further wherein said blower unit, on an end face thereof that faces said guide tube, is provided with at least one air inlet opening via which the operating air is adapted to be drawn into said blower unit, further wherein said blower tube, at an end thereof remote from said guide tube, is provided with an air outlet opening through which the operating air is adapted to be conveyed from said blower unit, further wherein a length of said guide tube measured between said engine housing and said blower housing is at least half of a length of said blower tube, further wherein a length of said axial fan is approximately 0.3 to 1.5 times the length of said blower tube, further wherein said axial fan includes a plurality of fan wheels and a plurality of guide wheels, further wherein all of said fan wheels are identical to one another and all of said guide wheels are identical to one another, each including a recess for receiving a bearing, further wherein said fan wheels are fixedly connected with a drive shaft portion that is driven by said drive shaft, further wherein said guide wheels are stationarially held in said blower housing, further wherein said drive shaft portion is rotatably mounted via two bearings, further wherein a first one of said bearings is disposed at a flow guide element that is disposed adjacent to said air inlet opening, and wherein a second one of said bearings is disposed in said recess in one of said guide wheels.

2. A blower according to claim 1, wherein said blower tube is rotationally symmetrical relative to said axis of rotation of said axial fan.

3. A blower according to claim 1, wherein said axial fan is provided with at least one fan wheel adapted to be driven by said drive shaft and at least one guide wheel fixedly disposed in said blower housing.

4. A blower according to claim 3, wherein at least two fan wheels and at least two guide wheels are provided.

5. A blower according to claim 1, wherein said blower housing is composed of at least two identical housing sections and is divided approximately parallel to said axis of rotation of said axial fan.

6. A blower according to claim 1, wherein a flow guide element is disposed at a downstream one of said guide wheels, and wherein an outer diameter of said flow guide element decreases in a direction of flow of air through said axial fan.

7. A blower according to claim 1, wherein the ratio of a drive power of said drive motor to the number of stages of said axial fan is approximately 0.25 kw to approximately 0.45 kw.

8. A blower according to claim 1, wherein said at least one handle includes a U-handle secured to said guide tube.

9. A blower according to claim 8, wherein said at least one handle includes a handgrip disposed on said guide tube, and wherein at least one control element for said drive motor is disposed on said handgrip.

10. A blower according to claim 1, which includes a coupling unit, wherein said blower unit is detachably held on said guide tube via said coupling unit.

11. A blower according to claim 10, wherein said blower unit is provided with a connector that cooperates with said coupling unit, and wherein said connector has an axial length of at least 40 mm.

12. A blower according to claim 1, wherein said axial fan has one to ten stages.

13. A blower according to claim 12, wherein said axial fan has two to five stages.

14. A blower according to claim 1, wherein the ratio of the drive power of said drive motor in watts to the conveying volume of said axial fan in $m^3/h$ is approximately 1.

15. A blower according to claim 1, wherein said drive motor is an internal combustion engine.

* * * * *